US009487322B2

(12) United States Patent
Wilkinson

(10) Patent No.: US 9,487,322 B2
(45) Date of Patent: Nov. 8, 2016

(54) METHOD AND APPARATUS PERTAINING TO A PLACEMENT OF A RADIO-FREQUENCY IDENTIFICATION TAG

(75) Inventor: Bruce W. Wilkinson, Rogers, AR (US)

(73) Assignee: Wal-Mart Stores, Inc., Bentonville, AR (US)

( * ) Notice: Subject to any disclaimer, the term of this patent is extended or adjusted under 35 U.S.C. 154(b) by 944 days.

(21) Appl. No.: 13/437,627

(22) Filed: Apr. 2, 2012

(65) Prior Publication Data

US 2013/0256175 A1 Oct. 3, 2013

(51) Int. Cl.
*G06K 19/00* (2006.01)
*B65D 5/56* (2006.01)

(52) U.S. Cl.
CPC ..... *B65D 5/563* (2013.01); *B65D 2203/10* (2013.01); *Y10T 29/49826* (2015.01)

(58) Field of Classification Search
USPC ..... 235/435, 439, 451, 487, 492; 340/10, 340/572
See application file for complete search history.

(56) References Cited

U.S. PATENT DOCUMENTS

| | | | | |
|---|---|---|---|---|
| 2,233,207 | A * | 2/1941 | Gillam | 229/162.4 |
| 6,034,644 | A * | 3/2000 | Okabe et al. | 343/767 |
| 2004/0135691 | A1* | 7/2004 | Duron et al. | 340/572.7 |
| 2009/0237217 | A1* | 9/2009 | Ohkubo | B65D 25/20 340/10.3 |
| 2010/0219252 | A1 | 9/2010 | Kikuchi | |
| 2011/0253792 | A1 | 10/2011 | Tuttle | |

FOREIGN PATENT DOCUMENTS

| | | |
|---|---|---|
| JP | 2011/040837 | 2/2011 |
| KR | 10-2011-0040270 | 4/2011 |
| KR | 10-2011-0070010 | 6/2011 |

OTHER PUBLICATIONS

PCT; App. No. PCT/US2013/034991; International Search Report mailed Jul. 25, 2013.
PCT; App. No. PCT/US2013/034991; Written Opinion mailed Jul. 25, 2013.
"EPC™ Radio-Frequency Identity Protocols Class-1 Generation-2 UHF RFID Protocol for Communications at 860 MHz-960 MHz Version 1.0.9;" Specification for RFID Air Interface by EPCglobal Inc.; 94 pages, Jan. 2005.

* cited by examiner

*Primary Examiner* — Matthew Mikels
(74) *Attorney, Agent, or Firm* — Fitch, Even, Tabin & Flannery LLP

(57) ABSTRACT

An RFID tag is secured to an electrically-conductive object having an external peripheral edge where first and second non-coplanar sides of the object meet one another, wherein at least the first non-coplanar side comprises electrically-conductive material. By one approach the RFID tag is secured to the first non-coplanar side of the object at the external peripheral edge such that a first portion of the RFID tag's antenna proximally overlies an electrically-conductive portion of the first non-coplanar side of the object while a second portion of the RFID tag's antenna does not proximally overlie any electrically-conductive portion of the object. Determining the size of the first portion of the RFID tag's antenna that will overlie the first non-coplanar side of the object comprises tuning the capacitive coupling between the first portion of the RFID tag's antenna and the object to thereby achieve a desired range and/or degree of RFID tag performance.

20 Claims, 4 Drawing Sheets

METHOD AND APPARATUS PERTAINING TO A PLACEMENT OF A RADIO-FREQUENCY IDENTIFICATION TAG

TECHNICAL FIELD

This invention relates generally to radio-frequency identification (RFID) tags.

BACKGROUND

RFID tags are known in the art. RFID tags are typically small circuits (that include a corresponding antenna) formed or disposed on support surfaces that are configured to respond to a radio-frequency (RF) signal with a corresponding data transmission. Some RFID tags are self-powered while others are passive in that they rely upon the received RF signal for their operating power (and some RFID tags are a hybrid of these two approaches).

Many times the RFID tag's data includes information, such as an identifier, that is unique (at least to some extent) to that particular responding RFID tag. The Electronic Product Code (EPC) as managed by EPCGlobal, Inc., for example, represents one such effort in these regards. EPC-based RFID tags each have an utterly unique serial number (within the EPC system) to thereby uniquely identify each tag and, by association, each item associated on a one-for-one basis with such tags. (The corresponding document entitled EPC Radio-Frequency Identity Protocols Class-1 Generation-2 UHF RFID Protocol for Communications at 860 MHz-960 MHz Version 1.0.9 (often referred to as "EPC GEN2") is hereby fully incorporated herein by this reference.)

RFID tags can be individually associated with any of a variety of products and product-containing packages to thereby facilitate automated or partially-automated inventory-control procedures, check-out procedures, and so forth. Unfortunately, some products/packages are comprised of electrically-conductive materials that can interfere with the ability of an RFID tag to receive and/or process radio-frequency (RF) energy. Such a circumstance, in turn, can defeat the ability of the RFID tag to function as desired.

As but one example in these regards, many fragrance products are packaged in a foil-lined paperboard container. A typical free-space passive RFID tag, placed upon the outer or inner surfaces of such a container, will often be unable to adequately rectify received RF energy and hence will not function properly. Designing an RFID tag to operate reliably in such an application setting can greatly increase the cost of the RFID tag, yielding a tag that is economically unsuitable for short-term, one-time use with a consumer product. An alternative solution involves placing a thick non-conductive spacer between the container and the RFID tag. Though less expensive, this approach can be highly visually noticeable, aesthetically unpleasing, and can reduce the number of containers that can be simultaneously displayed on a shelf or placed in a shipping container.

BRIEF DESCRIPTION OF THE DRAWINGS

The above needs are at least partially met through provision of the method and apparatus pertaining to placement of a radio-frequency identification tag described in the following detailed description, particularly when studied in conjunction with the drawings, wherein.

Figure 1:
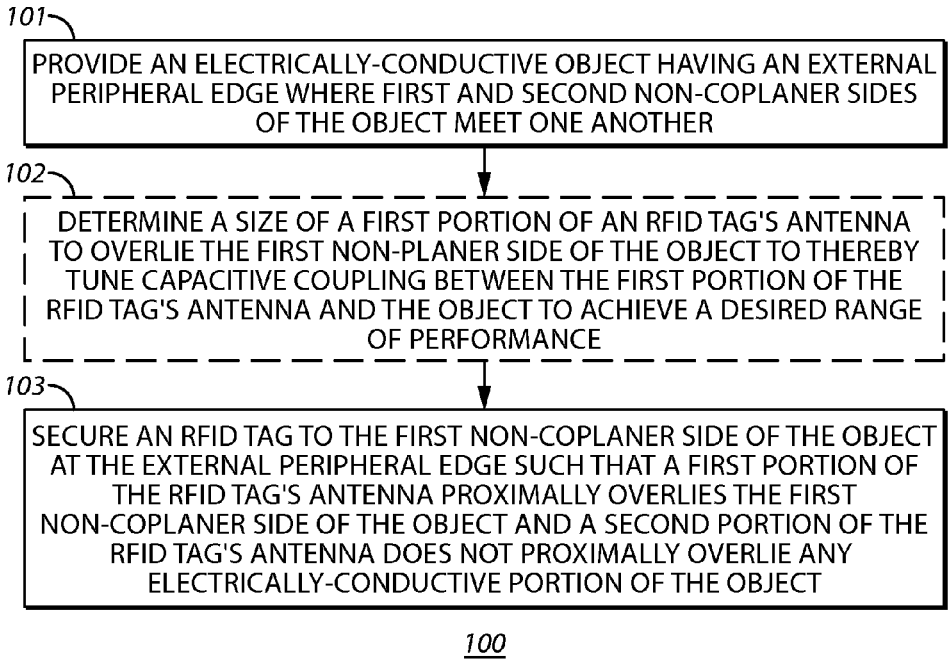
FIG. 1 comprises a flow diagram as configured in accordance with various embodiments of the invention.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, an RFID tag is secured to an electrically-conductive object having an external peripheral edge where first and second non-coplanar sides of the object meet one another and where at least the first non-coplanar side comprises electrically-conductive material (such as, by way of example, a foil liner). More particularly, the RFID tag is secured to the first non-coplanar side of the object at the external peripheral edge such that a first portion of the RFID tag's antenna proximally overlies an electrically-conductive portion of the first non-coplanar side of the object while a second portion of the RFID tag's antenna does not proximally overlie any electrically-conductive portion of the object.

The aforementioned object can comprise, for example, a package (such as a foil-lined container). These teachings will accommodate a wide range of objects, however, including shelves and parts of shelves (such as support braces).

By one approach, the RFID tag comprises a planar substrate that supports the aforementioned antenna. If desired, this planar substrate comprises a substantially transparent material and/or can comprise a resilient material that permits the planar substrate (and hence the RFID tag) to bend pliably and return at least substantially to a pre-bent orientation.

Generally speaking, and by one approach, determining the size of the first portion of the RFID tag's antenna that will overlie the first non-coplanar side of the object comprises tuning the capacitive coupling between the first portion of the RFID tag's antenna and the object to thereby achieve a desired range of RFID tag performance. So configured, the ability of the RFID tag to receive and rectify an adequate amount of power can not only be preserved notwithstanding close proximity of the tag to the electrically-conductive surface of the object, but such performance can actually be improved and increased in many instances.

The disposition of the second portion of the RFID tag's antenna can vary with the application setting. By one approach, for example, this second portion can extend outwardly of the package such that the second portion does not proximally overlie any portion of the package whatsoever. By another approach, and as another example, this second portion can be oriented perpendicularly to the first portion of the RFID's tag's antenna and secured, for example, to a part of the package that does not include an electrically-conductive material.

So configured, a simple, ordinary, and inexpensive RFID tag will function well in an operating environment that those skilled in the art would ordinarily view as being hostile to such usage. Furthermore, using this approach does little or nothing to disturb the packing-space and/or display-space requirements of the objects. These teachings will also readily accommodate RFID-tag form factors and approaches that generally tend to preserve the original design and appearance aesthetics of the object itself.

These and other benefits may become clearer upon making a thorough review and study of the following detailed description. Referring now to the drawings, and in particular to FIG. 1, an illustrative process 100 that is compatible with many of these teachings will now be presented.

Figure 2:
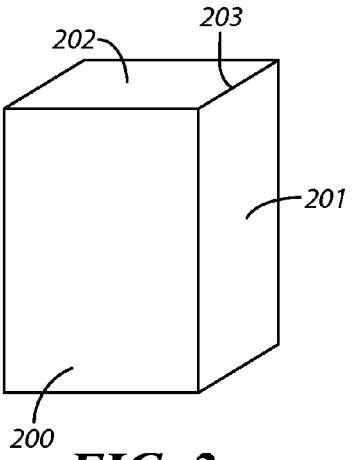
FIG. 2 comprises a perspective view as configured in accordance with various embodiments of the invention.

At step 101 this process 100 provides an electrically-conductive object. For the sake of illustration and without any intention of suggesting any limitations in these regards, this object can comprise, as shown in FIG. 2, a package 200. Such a package 200 can comprise, for example, a parallelepiped (such as the illustrated rectangular cuboid) though other form factors are of course possible. Such a package 200 might serve to contain, by way of example, bottles or other canisters of fragrance-bearing liquids.

Such a package 200 may or may not be comprised, for example, of paperboard (such as cardboard) material. In any event, in this illustrative example the package 200 also includes a substantially coextensive metal liner. This metal liner may be disposed coextensively on the interior surface of the package 200, on the exterior surface of the package 200, or as an interior layer (when, for example, the package 200 comprises a multiply laminate).

This package 200 includes, in part, first and second non-coplanar sides 201 and 202, respectively, that both include electrically-conductive material (i.e., the aforementioned foil in this particular illustrative example). (It will be understood that this reference to being "non-coplanar" refers to the fact that these two sides 201 and 202 are themselves non-coplanar with respect to one another.) These two sides 201 and 202, in turn, meet one another (in this case at a perpendicular angle) to form an external peripheral edge 203.

Figure 3:
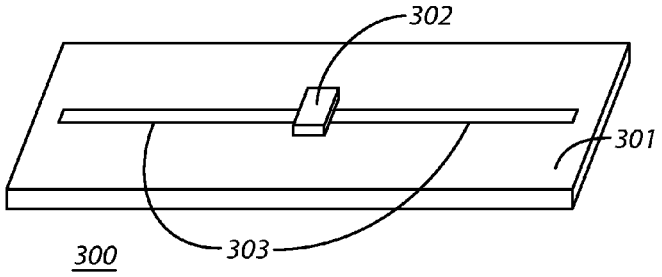
FIG. 3 comprises a perspective schematic view as configured in accordance with various embodiments of the invention.

As will be described momentarily, this process 100 will provide for placing an RFID tag in a particular orientation with respect to these two sides 201 and 202 and this edge 203. Referring to FIG. 3, this RFID tag 300 can comprise a planar substrate 301 that supports the other components that comprise the RFID tag 300. This planar substrate 301 can be comprised of a material of choice. By one approach the material can comprise a transparent (or substantially transparent) plastic material that is both pliable and resilient.

These other components can include an integrated circuit 302 that includes, for example, a control circuit and a corresponding memory. Such a control circuit can comprise a fixed-purpose hard-wired platform or can comprise a partially or wholly programmable platform. All of these architectural options are well known and understood in the art and require no further description here. The memory can serve to store executable code (when the control circuit comprises a partially or wholly programmable platform) and/or other information (such as a unique EPC code or the like).

In this illustrative example, the RFID tag 300 comprises a passive device. Accordingly, the control circuit relies upon received power for its own operating power. In particular, an antenna 303 receives a reader's RF signal. A rectifier as comprises a part of the integrated circuit 302 then rectifies that signal to provide a direct-current (DC) voltage and a corresponding regulator then typically regulates that DC voltage to provide stable operating power to the control circuit (and other components as desired). (Depending upon the sensitivity of the control circuit to voltage-level fluctuations, some RFID-tag architectures may eschew inclusion of the regulator.)

In this example the integrated circuit 302 is disposed and secured at, or near, the center area of the RFID tag 300. The antenna 303, in turn, comprises a dipole antenna having a first element that extends in a first direction from the integrated circuit 302 and a second element that extends in a second, opposite direction from the integrated circuit 302. Generally speaking, these teachings will accommodate using a free-space RFID tag that has not been specifically designed (in terms of the electrical components or the configuration of the antenna) for use with a package having the aforementioned metal liner or for use in close or intimate proximity to an electrically-conductive material.

Figure 4:
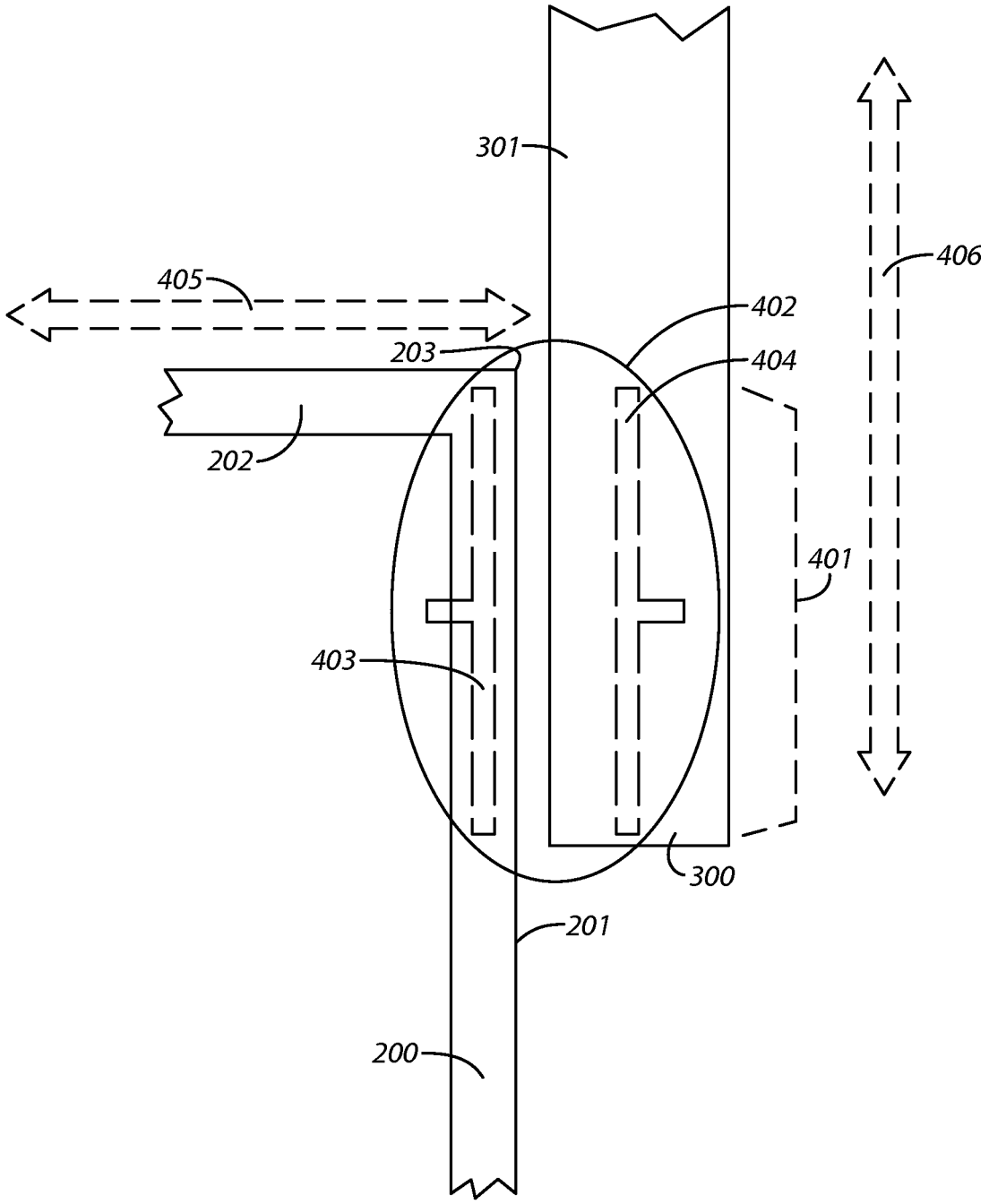
FIG. 4 comprises a side-elevational schematic view as configured in accordance with various embodiments of the invention.

Referring again to FIG. 1 and now FIG. 4 as well, this process 100, at optional step 102, provides for determining the size of a first portion 401 of the RFID tag's antenna 303 to overlie an electrically-conductive portion of the first non-coplanar side 201 of the package 200 that will correspond to tuning the capacitive coupling between that first portion 401 of the RFID tag's antenna 303 and the package 200 to achieve a desired range of performance. This desired range of performance can comprise, at least in part, a desired range of radio frequency performance by the RFID tag. More particularly, this performance can refer to an ability of the RFID tag, in the presence of a particular tag-reader RF signal, to receive and rectify a sufficient signal level to both power itself and to respond with modulation of its own data.

As illustrated in FIG. 4, the metallic portion of the first non-coplanar side 201 of the package 200 and the aforementioned first portion 401 of the RFID tag's antenna 303 form a capacitor 402. In particular, the metallic part of the first non-coplanar side 201 of the package 200 serves as a first plate 403 of that capacitor 402. Similarly, the first portion 401 of the RFID tag's antenna 303 serves as the second plate 404 of that capacitor 402.

Selecting the appropriate dimensions as described above, of course, also involves taking into account the type and size of the corresponding dielectric material. These teachings will accommodate a relatively thin dielectric material between these two plates 403 and 404. By one approach, for example, the dielectric can comprise the planar substrate 301 of the RFID tag 300 itself. By another approach (when, for example, the metallic portion of the package 300 comprises a foil liner on the interior of and coextensive with the package) the dielectric can comprise the non-conductive paperboard material that also comprises the package. By yet another approach (when, for example, a metallic foil comprises the exterior of the package 300), a layer of ink on the exterior of the package 300 may serve as the dielectric.

The RF signal from the RFID tag reader (schematically represented at various points in time in FIG. 4 by the reference numerals 405 and 406), which in this illustrative example will be presumed to range from about 902 to about 928 MHz, will effectively move back and forth in various orientations with respect to the package 200. This activity, in turn, will serve to cyclically charge and drain the aforementioned capacitor 402.

As the signal moves in one direction, the tag side of the capacitor 402 will charge. When the signal shifts direction the tag-antenna plate 404 of the capacitor 402 drains and hence pulls signal from that antenna portion of the RFID tag 300 that does not serve as a part of the capacitor 402. Then, as the signal again moves in that first direction the tag side of the capacitor 402 again charges. The charge on the capacitor therefore oscillates with respect to the reader's RF signal.

The size (and nature) of the dielectric and the size of the coupling area of the capacitor 402 will govern this oscillation. In particular, the time to charge (and discharge) is a function of the dielectric and the size of the coupling area. These teachings will accommodate a very thin dielectric. As a result, the two plates 403 and 404 of the capacitor 402 can be very close together (as per the illustrative example noted above when a layer of ink constitutes the dielectric). Under these circumstances the time to charge the capacitor 402 is very short indeed.

The appropriate juxtapositioning of the RFID tag 200 with respect to the package 300 therefore provides the means to tune the charging/discharging cycle of the capacitor 402 to permit the RFID tag to receive and rectify the reader's RF signal in a satisfactory manner. In particular, this tuning comprises determining how much of the RFID tag 300 is to serve as the first portion 401 that will proximally overlie an electrically-conductive portion of the first non-coplanar side 201 of the package 200 and how much of the RFID tag 300 will not proximally overlie any electrically-conductive portion of the package 200. If desired, these dimensions can be calculated. By another approach, these values are readily determined empirically by simple trial and error. Generally speaking, this tuning comprises determining the dimensions that result in both nominal or improved rectification results as well as nominal or improved back-scatter modulation performance.

Figure 5:
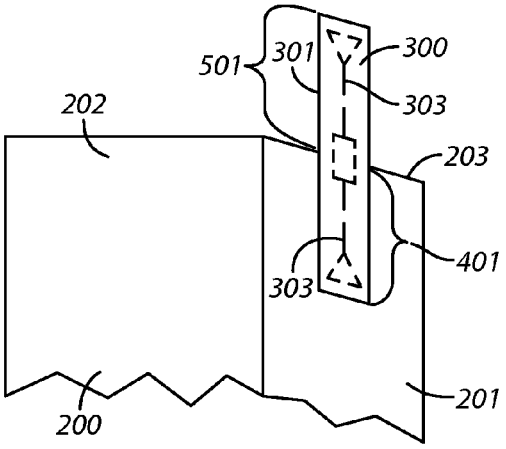
FIG. 5 comprises a perspective detail view as configured in accordance with various embodiments of the invention.
Figure 6:
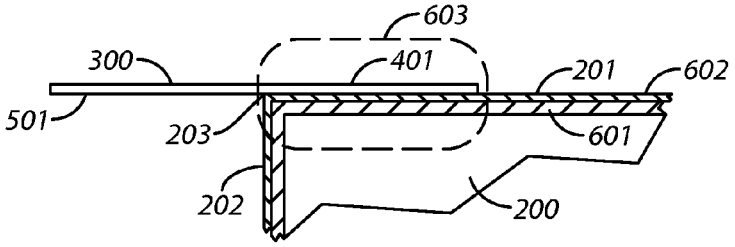
FIG. 6 comprises a side-elevational, cutaway, detail view as configured in accordance with various embodiments of the invention.

In any event, and referring now to FIGS. 1, 5, and 6, at step 103 this process 100 provides for securing an RFID tag 300 to the first non-coplanar side 201 of the package 200 at the external peripheral edge 203 such that the first portion 401 of the RFID tag's antenna 303 proximally overlies that first non-coplanar side 201 of the package 200 and such that a second portion 501 of the RFID tag's antenna 303 does not proximally overlie any electrically-conductive portion of the container 200. Given the rectangular cuboid shape of the container 200 in this example, this orientation causes the planar substrate 301 of the RFID tag 300 to be parallel to the first non-coplanar side 201 of the package 200 and perpendicular to the second non-coplanar side 202 of the package 200.

As illustrated particularly in FIG. 6, the package 200 includes a metal foil 601 that conforms to and comprises a coextensive external layer of the package 200. (For the sake of clarity, the paperboard portions of the package 200 are not shown in this view.) A layer of printed ink 602 comprises the outer-most layer of the package 200. This layer of printed ink 602 presents, for example, text and images that correspond to information regarding the contents of the package 200 such as promotional content, ingredients content, brand-management content, pricing information, use-by dates, and so forth as desired. In this example, the ink 602 that lies between the RFID tag 300 and the metal foil 601 (in the area that comprises the aforementioned capacitor as denoted by reference numeral 603) serves as the aforementioned capacitor dielectric.

The RFID tag 300 can be secured to the package 200 using any attachment mechanism of choice. Examples include, but are not limited to, adhesives, tapes, staples, brads, grommets, and so forth. The attachment process itself can be automated if desired (using, for example, an appropriate pick-and-place mechanism) or can be done by hand. By one approach, the appropriate location for the RFID tag 300 can be marked on the package 200 (using, for example, the aforementioned printed ink 602) to facilitate securing the RFID tag 200 at the appropriate location on the package 200.

The size of the RFID tag 300 can of course vary with the needs of the application setting. For many purposes it can be appropriate or useful for the RFID tag to be a few inches (such as, for example, two to five inches) in length. In many cases the portion 401 of the RFID tag 300 that overlies the package 200 will be about the same size as the portion 501 of the RFID tag 300 that does not proximally overlie any portion of the package 200 (give or take, say, ten, twenty, or thirty percent). Variations in these regards can of course occur, however, depending upon the nature and thickness of the dielectric as well as the size, shape, and nature of the package 200 itself.

Figure 7:
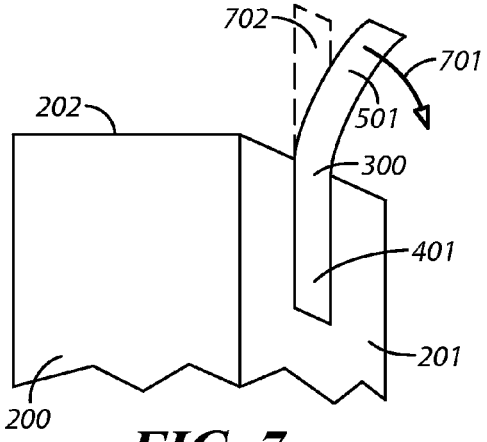
FIG. 7 comprises a perspective detail view as configured in accordance with various embodiments of the invention.

As noted above, the planar substrate 301 of the RFID tag 300 can be comprised of a pliable yet resilient material. As illustrated in FIG. 7, these properties will permit the unsecured portion 501 of the RFID tag 300 to flex when acted upon by a sufficient force 701 and then return to its unflexed state 702 in the absence of that force 701. Such a property can be helpful, for example, in an application setting when occasional application of such a force 701 can be expected during ordinary deployment and display of the package 200 in a retail setting.

Figure 8:
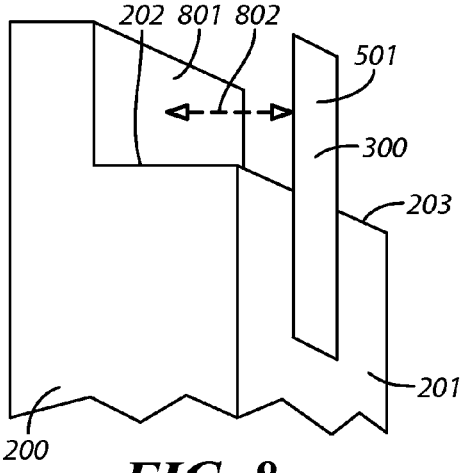
FIG. 8 comprises a perspective detail view as configured in accordance with various embodiments of the invention.

As noted above, in this particular illustrated example the unsecured portion 501 of the RFID tag 300 does not proximally overlie any portion of the package 200 regardless of whether that portion of the package 200 includes electrically-conductive material or not. This requirement should not be read as prohibiting non-proximal overlying of electrically-conductive portions of the package 200, however. FIG. 8 illustrates a package form factor, for example, where the unsecured portion 501 of the RFID tag 300 in fact overlies an electrically-conductive portion 801 of the package 200 by an open space and distance denoted by reference numeral 802. In this case, that free space distance 802 is of sufficient magnitude as to render the influence of any conductive metal in that underlying portion 801 of the package 200 on the aforementioned capacitive coupling as being essentially de minimus and functionally irrelevant.

Figure 9:
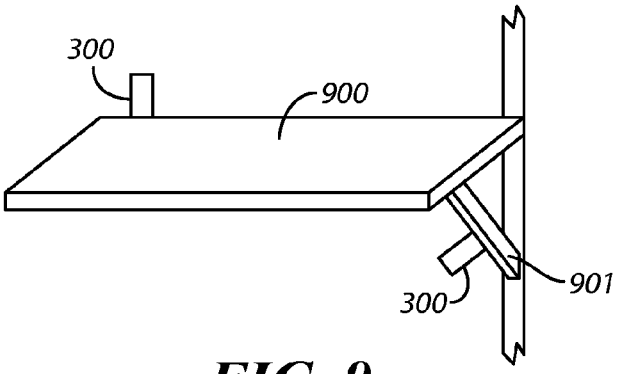
FIG. 9 comprises a perspective view as configured in accordance with various embodiments of the invention.

As noted earlier, these teachings can be applied with a variety of objects and that a package has been used merely as a useful illustrative example. FIG. 9 illustrates a metal shelf 900 and/or a metal shelf support member 901 that could also serve as the object of these teachings. In such a case, for example, the RFID tag 300 could be secured to the back edge of the shelf 900 and/or to the inside surface of the shelf support member 901 in the manner described herein.

Figure 10:
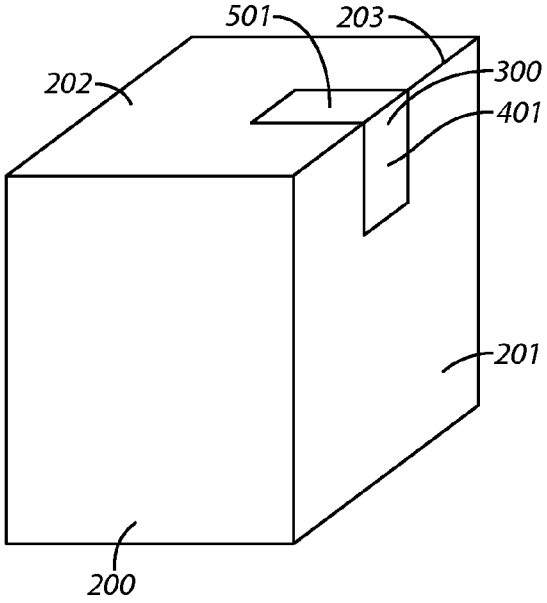
FIG. 10 comprises a perspective view as configured in accordance with various embodiments of the invention.

These teachings are also applicable towards use with a package 200 having a non-electrically conductive top lid but where the remaining portions of the package 200 are electrically conductive. With reference to FIG. 10, in such a case the first portion 401 of the RFID tag's antenna could proximally overlie an electrically-conductive portion of the first non-coplanar side 201 while the second portion 501 of the RFID tag's antenna bends perpendicularly to the first portion 401 (at the aforementioned edge 203) and proximally overlies that non-electrically conductive top lid that comprises the second non-coplanar side 202 of the package 200. If desired, that second portion 501 can be fastened to that top lid (using, for example, an appropriate adhesive) in order to persist that orientation. In this case the entire RFID tag 300 conforms closely to the form factor of the package 200.

So configured, an inexpensive and otherwise relatively ordinary and mundane free-space RFID tag can serve in an application setting not ordinarily viewed as being appropriate for such a tag. In addition, these free-space RFID tags can of course be used in more ordinary application settings (i.e., in conjunction with products and packaging that do not present interference issues) to thereby provide a significant economy-of-scale opportunity. This, in turn, can lead to considerably reduced implementation and deployment costs for all parties concerned (including the consumer) as well as bringing the benefits of RFID-based capabilities to a range of packages and products that might otherwise remain excluded in these regards.

Figure 11:
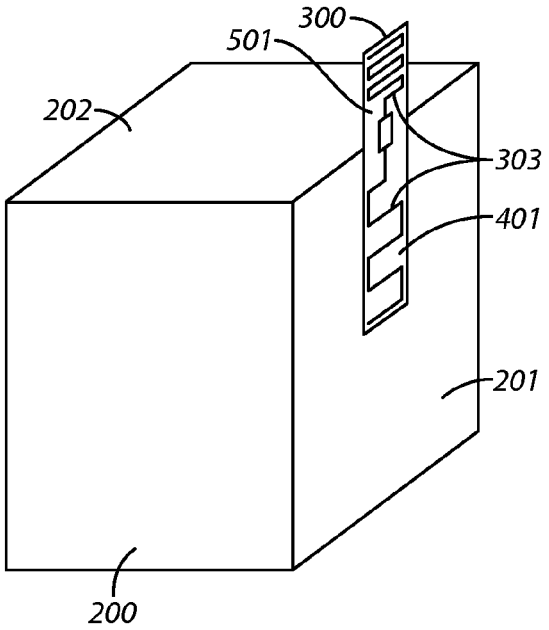
FIG. 11 comprises a perspective view as configured in accordance with various embodiments of the invention.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in these regards, and referring to FIG. 11, these teachings will readily accommodate an RFID tag 300 having a physically-asymmetric antenna 303. In the illustrated example, the first portion 401 of the antenna 303 (which is the portion that proximally overlies an electrically-conductive portion of the first non-coplanar side 201) extends further longitudinally as compared to the second portion 501 of the antenna 303 (which is the portion that does not proximally overly an electrically-conductive portion of the package 200). Presuming that the overall length of the antenna traces are themselves essentially the same the electrical symmetry will be preserved at least to some substantial degree, but the physical portion of the RFID tag 300 that extends outwardly of the package 200 is reduced as compared to some of the approaches described above.

I claim:

1. A method comprising:

providing a package having an external peripheral edge where first and second non-coplanar sides of the package meet one another, wherein at least the first non-coplanar side comprises electrically-conductive material;

securing a radio-frequency identification (RFID) tag to the first non-coplanar side of the package at the external peripheral edge such that a first portion of the RFID tag's antenna overlies an electrically-conductive portion of the first non-coplanar side of the package and a second portion of the RFID tag's antenna does not overlie any electrically-conductive portion of the package, wherein the second portion of the RFID tag's antenna overlies one of:

the second non-coplanar side of the package; and no part of the package.

2. The method of claim 1 wherein the package comprises a parallelepiped.

3. The method of claim 2 wherein the parallelepiped comprises a rectangular cuboid.

4. The method of claim 1 wherein the RFID tag comprises a planar substrate that supports the antenna.

5. The method of claim 4 wherein the planar substrate is parallel to the first non-coplanar side of the package and perpendicular to the second non-coplanar side of the package.

6. The method of claim 4 wherein the planar substrate comprises a substantially transparent material.

7. The method of claim 4 wherein the planar substrate comprises a resilient material.

8. The method of claim 1 further comprising:

determining the size of the first portion of the RFID tag's antenna to overlie the first non-coplanar side of the package to thereby tune capacitive coupling between the first portion of the RFID tag's antenna and the package to achieve a desired range of performance.

9. The method of claim 8 wherein the desired range of performance comprises, at least in part, a desired range of radio frequency performance by the RFID tag.

10. The method of claim 1 wherein the package includes a substantially coextensive metal liner.

11. The method of claim 10 wherein the metal liner of the package serves as a plate of a capacitor having a remaining plate that comprises the first portion of the RFID tag's antenna.

12. An apparatus comprising:

a package having an external peripheral edge where first and second non-coplanar sides of the package meet one another, wherein at least the first non-coplanar side comprises electrically-conductive material;

a radio-frequency identification (RFID) tag secured to the first non-coplanar side of the package at the external peripheral edge such that a first portion of the RFID tag's antenna overlies an electrically-conductive portion of the first non-coplanar side of the package and a second portion of the RFID tag's antenna does not overlie any electrically-conductive portion of the package, wherein the second portion of the RFID tag's antenna overlies one of:

the second non-coplanar side of the package; and no part of the package.

13. The apparatus of claim 12 wherein the package comprises a rectangular cuboid.

14. The apparatus of claim 12 wherein the RFID tag comprises a planar substrate that supports the antenna.

15. The apparatus of claim 14 wherein the planar substrate is parallel to the first non-coplanar side of the package and perpendicular to the second non-coplanar side of the package.

16. The apparatus of claim 14 wherein the planar substrate comprises a substantially transparent material.

17. The apparatus of claim 14 wherein the planar substrate comprises a resilient material.

18. The apparatus of claim 12 wherein the size of the first portion of the RFID tag's antenna that overlies the first non-planar side of the package is selected to tune capacitive coupling between the first portion of the RFID tag's antenna and the package to achieve a desired range of RFID tag performance.

19. A method comprising:

providing an electrically-conductive object having an external peripheral edge where first and second non-coplanar sides of the object meet one another, wherein at least the first non-coplanar side comprises electrically-conductive material;

securing a radio-frequency identification (RFID) tag to the first non-coplanar side of the object at the external peripheral edge such that a first portion of the RFID tag's antenna overlies an electrically-conductive portion of the first non-coplanar side of the object and a second portion of the RFID tag's antenna does not overlie any electrically-conductive portion of the object, wherein the second portion of the RFID tag's antenna overlies one of:

the second non-coplanar side of the package; and no part of the package.

20. The method of claim 19 wherein the object comprises one of:

a part of a shelf;

a container.

* * * * *